US011753226B2

(12) United States Patent
McCree et al.

(10) Patent No.: US 11,753,226 B2
(45) Date of Patent: Sep. 12, 2023

(54) CARRIER FOR CONTAINERS

(71) Applicant: Graphic Packaging International, LLC, Atlanta, GA (US)

(72) Inventors: Justin McCree, Bristol (GB); Steve M. Gould, Bristol (GB)

(73) Assignee: Graphic Packaging International, LLC, Atlanta, GA (US)

( * ) Notice: Subject to any disclaimer, the term of this patent is extended or adjusted under 35 U.S.C. 154(b) by 77 days.

(21) Appl. No.: 17/487,262

(22) Filed: Sep. 28, 2021

(65) Prior Publication Data

US 2022/0097938 A1 Mar. 31, 2022

Related U.S. Application Data

(60) Provisional application No. 63/208,646, filed on Jun. 9, 2021, provisional application No. 63/136,400, filed (Continued)

(51) Int. Cl.
*B65D 71/72* (2006.01)
*B65D 71/42* (2006.01)

(Continued)

(52) U.S. Cl.
CPC ..... *B65D 71/72* (2013.01); *B31B 50/262* (2017.08); *B65D 71/42* (2013.01); *B31B 50/20* (2017.08);

(Continued)

(58) Field of Classification Search
CPC ..... B31B 50/20; B31B 50/262; B31B 50/86; B31B 2100/00; B31B 100/00;

(Continued)

(56) References Cited

U.S. PATENT DOCUMENTS 1,527,399 A 2/1925 Davidson
2,289,859 A 7/1942 Arthur (Continued)

FOREIGN PATENT DOCUMENTS

AT 399701 B 7/1995
CA 2133827 10/1993

(Continued)

OTHER PUBLICATIONS

"Florida brewery unveils six-pack rings that spare sea turtles, not snare them," by Thomas Leavy, CBSNews.com. Date posted: May 24, 2018. Site visited: Sep. 12, 2022. Available online: https://www.cbsnews.com/news/florida-saltwater-brewery-non-plastic-six-pack-rings-spare-sea-turtles/ (Year: 2018).

(Continued)

*Primary Examiner* — Bryon P Gehman
(74) *Attorney, Agent, or Firm* — WOMBLE BOND DICKINSON (US) LLP

(57) ABSTRACT

A carrier for holding a plurality of containers includes a top panel having a first plurality of container openings, at least one container retention flap foldably connected to the top panel and having a second plurality of container openings aligned with respective container openings of the first plurality of container openings, at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, and at least one reinforcement panel (Continued)

positioned between the top panel and the at least one container retention flap.

54 Claims, 5 Drawing Sheets

Related U.S. Application Data on Jan. 12, 2021, provisional application No. 63/120,863, filed on Dec. 3, 2020, provisional application No. 63/086,681, filed on Oct. 2, 2020, provisional application No. 63/085,365, filed on Sep. 30, 2020.

(51) Int. Cl.
*B31B 50/26* (2017.01)
*B31B 50/86* (2017.01)
*B31B 50/20* (2017.01)
*B31B 100/00* (2017.01)

(52) U.S. Cl.
CPC ..... *B31B 50/86* (2017.08); *B31B 2100/00* (2017.08); *B65D 2571/0029* (2013.01); *B65D 2571/0066* (2013.01); *B65D 2571/00141* (2013.01); *B65D 2571/00259* (2013.01); *B65D 2571/00444* (2013.01); *B65D 2571/00561* (2013.01)

(58) Field of Classification Search
CPC ..... B65D 71/40; B65D 71/42; B65D 71/44; B65D 71/46; B65D 71/72; B65D 2571/00141; B65D 2571/00259; B65D 2571/0029; B65D 2571/00444; B65D 2571/00561; B65D 2571/0066
USPC ..... 206/148, 149, 153, 161, 427
See application file for complete search history.

(56) References Cited

U.S. PATENT DOCUMENTS 2,320,440 A 6/1943 Kruea
2,331,038 A 10/1943 Meller
2,397,376 A 3/1946 Caldwell
2,397,716 A 4/1946 Wendler
2,522,950 A 9/1950 Keith
2,594,376 A 4/1952 Arneson
2,594,377 A 4/1952 Arneson
2,737,326 A 3/1956 Toensmeier
2,798,603 A 7/1957 Grinspoon
2,950,041 A 8/1960 Stone
2,965,410 A 12/1960 Hughes
3,001,647 A 9/1961 Liss
3,046,711 A 7/1962 Harrison
3,061,141 A 10/1962 Cote
3,094,210 A 6/1963 Van Der Berg
3,099,475 A 7/1963 Manizza
3,118,537 A 1/1964 Copping
3,128,034 A 4/1964 Weiss
3,137,109 A 6/1964 Rapata
3,146,885 A 9/1964 Grantham
3,156,358 A 11/1964 Randrup
3,200,944 A 8/1965 Rapata
3,223,308 A 12/1965 Weiss
3,245,711 A 4/1966 Dantoin
3,257,066 A 6/1966 Williams
3,281,180 A 10/1966 Spery
3,302,784 A 2/1967 Copping
3,387,879 A 6/1968 Wood
3,404,912 A 10/1968 Watts
3,410,596 A 11/1968 Slevin, Jr.
3,432,202 A 3/1969 Ebelhardt
3,463,535 A 8/1969 Beart
3,528,697 A 9/1970 Wood
3,587,847 A 6/1971 Graser
3,601,439 A 8/1971 Poupitch
3,612,266 A 10/1971 Graser
D222,579 S 11/1971 Oglesbee
3,627,121 A 12/1971 Deasy
3,653,503 A 4/1972 Arneson
3,693,787 A 9/1972 Duerr
3,698,550 A 10/1972 Graser
3,701,416 A 10/1972 Lawrence
3,722,945 A 3/1973 Wood
3,726,558 A 4/1973 Klygis
3,734,278 A 5/1973 Kerrigan
3,876,066 A 4/1975 Klygis
3,897,873 A 8/1975 Graser
3,924,739 A 12/1975 Gravesteijn
3,942,631 A 3/1976 Sutherland et al.
4,029,204 A 6/1977 Manizza
4,111,298 A 9/1978 Mascia
4,120,396 A 10/1978 Mascia
4,136,772 A 1/1979 Mascia
4,155,502 A 5/1979 Forte
4,190,149 A 2/1980 Oliff et al.
D257,001 S 9/1980 Oliff
4,244,617 A 1/1981 Manizza
4,304,329 A 12/1981 Graser
D265,292 S 7/1982 Killy
4,339,032 A 7/1982 Wood
D265,979 S 8/1982 Arfert
4,372,599 A 2/1983 Kiedaisch et al.
4,378,879 A 4/1983 Killy
4,382,505 A 5/1983 Sutherland et al.
4,441,611 A 4/1984 Sommariva
4,453,630 A 6/1984 Helms
4,471,870 A 9/1984 Uhlig
4,523,676 A 6/1985 Barrash
D294,331 S 2/1988 Panazzolo
4,784,266 A 11/1988 Chaussadas
D304,017 S 10/1989 Oliff
4,911,288 A 3/1990 Dantoin, Jr.
4,974,726 A 12/1990 Klygis et al.
5,002,225 A 3/1991 Bienaime
5,065,862 A 11/1991 Mousseau
5,103,971 A 4/1992 Schuster
5,125,506 A 6/1992 Galbierz et al.
5,135,104 A 8/1992 Jorba
5,139,147 A 8/1992 Sutherland
D329,807 S 9/1992 Heider
5,188,225 A 2/1993 Jorba
5,193,673 A 3/1993 Rathbone et al.
5,201,412 A 4/1993 Schuster et al.
5,230,425 A 7/1993 Edqvist et al.
5,246,113 A 9/1993 Schuster
5,263,299 A 11/1993 Galbierz et al.
5,267,644 A 12/1993 Tsao
5,282,348 A 2/1994 Dampier et al.
5,297,673 A 3/1994 Sutherland
5,310,050 A 5/1994 Sutherland
5,310,051 A 5/1994 Sutherland
5,314,224 A 5/1994 Bates
5,318,178 A 6/1994 Davies et al.
5,323,895 A 6/1994 Sutherland et al.
5,328,024 A 7/1994 Sutherland
5,335,774 A 8/1994 Ganz
5,351,815 A 10/1994 Fogle et al.
5,351,816 A 10/1994 Sutherland et al.
5,351,817 A 10/1994 Sutherland
5,355,999 A 10/1994 Sutherland
5,360,104 A 11/1994 Sutherland
5,390,784 A 2/1995 Sutherland
5,407,065 A 4/1995 Sutherland
5,415,278 A 5/1995 Sutherland
5,425,446 A 6/1995 Weaver
5,443,153 A 8/1995 Sutherland
5,445,262 A 8/1995 Sutherland
5,452,799 A 9/1995 Sutherland
5,484,053 A 1/1996 Harris
5,485,914 A 1/1996 Martin
5,487,464 A 1/1996 Galbierz et al.
5,490,593 A 2/1996 Gordon et al.

(56) References Cited

U.S. PATENT DOCUMENTS

| | | | |
|---|---|---|---|
| 5,503,267 | A | 4/1996 | Sutherland |
| 5,520,283 | A | 5/1996 | Sutherland |
| 5,524,756 | A | 6/1996 | Sutherland |
| 5,551,566 | A | 9/1996 | Sutherland |
| 5,553,704 | A | 9/1996 | Gordon et al. |
| 5,553,705 | A | 9/1996 | Bakx |
| 5,573,111 | A | 11/1996 | Gordon |
| 5,590,776 | A | 1/1997 | Galbierz |
| 5,593,027 | A | 1/1997 | Sutherland |
| 5,609,247 | A | 3/1997 | Appleton |
| 5,609,251 | A | 3/1997 | Harris |
| 5,609,379 | A | 3/1997 | Harrelson |
| 5,639,137 | A | 6/1997 | Bakx |
| 5,682,982 | A | 11/1997 | Stonehouse |
| 5,706,936 | A | 1/1998 | Bernstein |
| 5,711,419 | A | 1/1998 | Beales et al. |
| 5,735,394 | A | 4/1998 | Harrelson |
| 5,746,310 | A | 5/1998 | Slomski |
| 5,762,193 | A | 6/1998 | Marco |
| 5,791,463 | A | 8/1998 | Negelen |
| 5,816,391 | A | 10/1998 | Harris |
| 5,845,776 | A | 12/1998 | Galbierz et al. |
| 5,878,876 | A | 3/1999 | Galbierz et al. |
| 5,960,945 | A | 10/1999 | Sutherland |
| 6,039,181 | A | 3/2000 | Whiteside |
| 6,059,099 | A | 5/2000 | Galbierz |
| 6,082,532 | A | 7/2000 | Miess |
| 6,145,656 | A | 11/2000 | Marco |
| 6,293,392 | B1 | 9/2001 | Galbierz |
| 6,315,111 | B1 | 11/2001 | Sutherland |
| 6,394,272 | B1 | 5/2002 | Domansky |
| 6,896,130 | B2 | 5/2005 | Theelen |
| D506,925 | S | 7/2005 | Plumer |
| 7,011,209 | B2 | 3/2006 | Sutherland et al. |
| 7,690,507 | B2 | 4/2010 | Sutherland |
| 7,721,878 | B2 | 5/2010 | Requena |
| 7,762,397 | B2 | 7/2010 | Coltri-Johnson et al. |
| 7,789,231 | B2 | 9/2010 | Requena |
| 7,823,721 | B2 | 11/2010 | Sutherland et al. |
| 8,056,709 | B2 | 11/2011 | Sutherland |
| 8,096,413 | B2 | 1/2012 | Coltri DePaula |
| 8,162,135 | B2 | 4/2012 | Oliveira |
| 8,353,398 | B2 | 1/2013 | DePaula et al. |
| 8,387,784 | B2 | 3/2013 | Gonzalez et al. |
| 8,443,968 | B2 | 5/2013 | DePaula |
| 8,464,866 | B2 | 6/2013 | Sutherland et al. |
| 8,469,184 | B2 | 6/2013 | Spivey, Sr. |
| 8,602,209 | B2 | 12/2013 | Jones et al. |
| 8,631,932 | B2 | 1/2014 | Holley, Jr. |
| 8,701,878 | B2 | 4/2014 | Spivey, Sr. |
| 8,925,720 | B2 | 1/2015 | Sutherland et al. |
| 8,936,149 | B2 | 1/2015 | Smalley |
| 8,955,674 | B2 | 2/2015 | Spivey, Sr. et al. |
| 9,079,699 | B2 | 7/2015 | Holley, Jr. |
| 9,169,050 | B2 | 10/2015 | Spivey, Sr. |
| 9,284,090 | B2 | 3/2016 | Lettre |
| 9,359,093 | B2 | 6/2016 | DePaula et al. |
| 9,376,250 | B2 | 6/2016 | Spivey, Sr. |
| D767,408 | S | 9/2016 | Shuster |
| 9,446,891 | B2 | 9/2016 | Jones et al. |
| 9,511,916 | B2 | 12/2016 | Holley, Jr. |
| 9,669,976 | B2 | 6/2017 | Kastanek et al. |
| 9,676,535 | B2 | 6/2017 | Spivey, Sr. |
| 10,077,131 | B2 | 9/2018 | Lettre |
| D881,021 | S | 4/2020 | Bandinu |
| D881,718 | S | 4/2020 | Bandinu |
| 10,836,550 | B2 | 11/2020 | Zacherle |
| D918,057 | S | 5/2021 | L'Heureux |
| D918,058 | S | 5/2021 | L'Heureux |
| 11,014,727 | B2 | 5/2021 | McCree |
| D920,809 | S | 6/2021 | Chesnet et al. |
| D921,493 | S | 6/2021 | Chesnet |
| D923,416 | S | 6/2021 | Luciano |
| 11,027,905 | B2 | 6/2021 | Ford |
| 11,180,301 | B2 | 11/2021 | Smalley |
| D944,656 | S | 3/2022 | Spivey, Sr. |
| D946,416 | S | 3/2022 | Smalley |
| D946,417 | S | 3/2022 | Gonzalez Manzano |
| D946,418 | S | 3/2022 | Gonzalez Manzano |
| D946,419 | S | 3/2022 | Gonzalez Manzano |
| D946,420 | S | 3/2022 | Gonzalez Manzano |
| D946,421 | S | 3/2022 | Gonzalez Manzano |
| 11,261,013 | B2 | 3/2022 | Smalley |
| 11,286,094 | B2 | 3/2022 | Gonzalez Manzano |
| D955,889 | S | 6/2022 | Gonzalez Manzano |
| D955,890 | S | 6/2022 | Gonzalez Manzano |
| D956,574 | S | 7/2022 | Gonzalez Manzano |
| 11,401,095 | B2 | 8/2022 | Rosenbrien |
| 11,420,802 | B2 | 8/2022 | Kooc |
| D962,789 | S | 9/2022 | Noel |
| 2002/0195371 | A1 | 12/2002 | Brown |
| 2003/0080004 | A1 | 5/2003 | Olsen et al. |
| 2003/0213705 | A1 | 11/2003 | Woog |
| 2004/0206639 | A1 | 10/2004 | Karlsson |
| 2004/0211695 | A1 | 10/2004 | Karlsson |
| 2004/0226833 | A1 | 11/2004 | Daniel |
| 2005/0127151 | A1 | 6/2005 | Johnson |
| 2005/0199513 | A1 | 9/2005 | Bakx et al. |
| 2006/0255114 | A1 | 11/2006 | Hand et al. |
| 2007/0080084 | A1 | 4/2007 | Sutherland |
| 2007/0163908 | A1 | 7/2007 | Sutherland |
| 2009/0101526 | A1 | 4/2009 | Sutherland et al. |
| 2009/0127147 | A1 | 5/2009 | Sutherland |
| 2010/0078337 | A1 | 4/2010 | Sutherland et al. |
| 2010/0264043 | A1 | 10/2010 | DePaula |
| 2011/0000799 | A1 | 1/2011 | Gonzalez |
| 2012/0138489 | A1 | 6/2012 | Holley, Jr. |
| 2015/0191287 | A1 | 7/2015 | L'Heureux et al. |
| 2016/0325899 | A1 | 11/2016 | L'Heureux et al. |
| 2018/0111734 | A1 | 4/2018 | Jego |
| 2018/0222650 | A1 | 8/2018 | Zacherle |
| 2018/0362234 | A1 | 12/2018 | L'Heureux et al. |
| 2019/0119019 | A1 | 4/2019 | Patton |
| 2020/0010255 | A1 | 1/2020 | Zacherle et al. |
| 2020/0079564 | A1 | 3/2020 | Ford |
| 2020/0189817 | A1 | 6/2020 | Smalley |
| 2020/0189818 | A1 | 6/2020 | McCree |
| 2020/0189819 | A1 | 6/2020 | McCree |
| 2020/0189821 | A1 | 6/2020 | Smalley |
| 2020/0189822 | A1 | 6/2020 | Smalley |
| 2020/0223612 | A1 | 7/2020 | Swenson |
| 2021/0061502 | A1 | 3/2021 | Johnston |
| 2021/0094742 | A1 | 4/2021 | Gonzalez Manzano |
| 2021/0276776 | A1 | 9/2021 | Zammit |
| 2021/0316921 | A1 | 10/2021 | Holtz |
| 2021/0331847 | A1 | 10/2021 | Gonzalez Manzano |
| 2021/0331848 | A1 | 10/2021 | Gonzalez Manzano |
| 2021/0339928 | A1 | 11/2021 | Blin |
| 2022/0009685 | A1 | 1/2022 | Thompson |
| 2022/0097941 | A1 | 3/2022 | McCree |

FOREIGN PATENT DOCUMENTS

| | | | |
|---|---|---|---|
| DE | 298 13 672 | U1 | 11/1998 |
| DE | 203 19 247 | U1 | 5/2004 |
| DE | 10 2009 059 047 | A1 | 6/2011 |
| EP | 0 051 413 | A1 | 5/1982 |
| EP | 0 060 504 | A2 | 9/1982 |
| EP | 0 057 437 | B1 | 5/1985 |
| EP | 0 496 807 | | 6/1993 |
| EP | 0 636 096 | | 2/1995 |
| EP | 0 715 593 | A1 | 6/1996 |
| EP | 0 398 835 | B1 | 10/1996 |
| EP | 2 067 713 | A1 | 6/2009 |
| EP | 1 528 007 | B1 | 10/2010 |
| EP | 2739547 | B1 | 7/2017 |
| EP | 3 666 684 | A1 | 6/2020 |
| EP | 3 666 685 | A1 | 6/2020 |
| FR | 2 737 196 | A1 | 1/1997 |
| GB | 1 256 684 | | 12/1971 |
| GB | 2 321 229 | A | 7/1998 |
| GB | 9006736716 | | 8/2019 |
| GB | 2591535 | A | 8/2021 |
| GB | 6161591 | | 9/2021 |

(56) References Cited

FOREIGN PATENT DOCUMENTS

| | | | |
|---|---|---|---|
| JP | 10-297668 | A | 11/1998 |
| JP | 2001-519300 | A | 10/2001 |
| JP | 2003-146359 | | 5/2003 |
| JP | 2004-189243 | A | 7/2004 |
| JP | 2015-048088 | A | 3/2015 |
| JP | 2016-124605 | | 7/2016 |
| KR | 10-2005-0051616 | A | 6/2005 |
| KR | 10-2020-0106806 | A | 9/2020 |
| KR | 301130233 | | 10/2021 |
| WO | WO 93/02941 | | 2/1993 |
| WO | WO 93/21083 | | 10/1993 |
| WO | WO 93/25439 | A1 | 12/1993 |
| WO | WO 94/22738 | A1 | 10/1994 |
| WO | WO 95/01289 | A1 | 1/1995 |
| WO | WO 95/06604 | | 3/1995 |
| WO | WO 96/26128 | A1 | 8/1996 |
| WO | WO 96/32340 | A1 | 10/1996 |
| WO | WO 2008/058294 | A1 | 5/2008 |
| WO | WO 2010/006629 | A1 | 1/2010 |
| WO | WO 2010/101852 | A1 | 9/2010 |
| WO | WO 2016/112145 | A1 | 7/2016 |
| WO | WO 2021/168417 | A1 | 8/2021 |
| WO | WO 2021/188751 | A1 | 9/2021 |
| WO | WO 2021/262858 | A1 | 12/2021 |

OTHER PUBLICATIONS

"Pepsi trials molded pulp alternative to plastic rings" in BeverageDaily.com. Date posted: Feb. 28, 2020. Site visited: Sep. 12, 2022. Available online: https://www.beveragedaily.com/Article/2020/02/28/Pepsi-trials-molded-pulp-alternative-to-plastic-rings# (Year: 2020).
Enviroclip. Date posted: 2022. Site visited: Sep. 12, 2022. Available online: https://www.graphicpkg.com/products/enviroclip/ (Year: 2022).
"Paperboard Can Handle Applicator," as seen in Packaging World Online. Date first available: 2020. Site visited: Sep. 13, 2022. Available online: https://www.packworld.com/news/sustainability/article/21202650/paperboard-can-handle-applicator (Year: 2020).
"The 'ECOGRIP' Corrugated Bottle Carrier is a Plastic Alternative" in Trendhunter.com. Date published: Jan. 20, 2021. Site visited: Sep. 12, 2022. Available online: https://www.trendhunter.com/trends/corrugated-bottle-carrier (Year: 2021).
Cap-it packaging video on Vimeo. Date posted: 2021. Site visited: Sep. 19, 2022. Available online: https://vimeo.com/610619455?embedded=true&source=vimeo_logo&owner=24551687 (Year: 2021).
2020 Package of the Year and Innovation of the Year on YouTube. Date posted: Oct. 19, 2020. Site visited: Sep. 12, 2022. Available online: https://www.youtube.com/watch?v=wxwpM4hodFA (Year: 2020).
U.S. Appl. No. 16/426,050, filed May 30, 2019.
U.S. Appl. No. 16/426,057, filed May 30, 2019.
U.S. Appl. No. 16/426,060, filed May 30, 2019.
U.S. Appl. No. 16/426,063, filed May 30, 2019.
U.S. Appl. No. 16/426,066, filed May 30, 2019.
U.S. Appl. No. 29/692,992, filed May 30, 2019.
U.S. Appl. No. 29/692,993, filed May 30, 2019.
U.S. Appl. No. 29/692,994, filed May 30, 2019.
U.S. Appl. No. 29/692,996, filed May 30, 2019.
U.S. Appl. No. 29/692,997, filed May 30, 2019.
U.S. Appl. No. 16/598,282, filed Oct. 10, 2019.
U.S. Appl. No. 29/709,918, filed Oct. 18, 2019.
U.S. Appl. No. 16/829,346, filed Mar. 25, 2020.
U.S. Appl. No. 29/735,178, filed May 19, 2020.
U.S. Appl. No. 16/937,043, filed Jul. 23, 2020.
U.S. Appl. No. 29/739,927, filed Jun. 30, 2020.
U.S. Appl. No. 29/739,929, filed Jun. 30, 2020.
U.S. Appl. No. 29/739,931, filed Jun. 30, 2020.
U.S. Appl. No. 29/739,933, filed Jun. 30, 2020.
U.S. Appl. No. 29/739,934, filed Jun. 30, 2020.
U.S. Appl. No. 17/118,999, filed Dec. 11, 2020.
U.S. Appl. No. 17/119,106, filed Dec. 11, 2020.
U.S. Appl. No. 17/119,040, filed Dec. 11, 2020.
U.S. Appl. No. 16/562,957, filed Sep. 6, 2019.
U.S. Appl. No. 17/036,775, filed Sep. 29, 2020.
U.S. Appl. No. 17/231,368, filed Apr. 15, 2021.
U.S. Appl. No. 17/245,583, filed Apr. 30, 2021.
U.S. Appl. No. 17/478,025, filed Sep. 17, 2021.
U.S. Appl. No. 17/487,113, filed Sep. 28, 2021.
U.S. Appl. No. 17/487,131, filed Sep. 28, 2021.
U.S. Appl. No. 17/487,141, filed Sep. 28, 2021.
U.S. Appl. No. 29/775,557, filed Mar. 24, 2021.
U.S. Appl. No. 29/775,558, filed Mar. 24, 2021.
U.S. Appl. No. 29/775,559, filed Mar. 24, 2021.
U.S. Appl. No. 29/775,560, filed Mar. 24, 2021.
U.S. Appl. No. 29/818,355, filed Dec. 8, 2021.
U.S. Appl. No. 29/819,435, filed Dec. 15, 2021.
U.S. Appl. No. 29/819,437, filed Dec. 15, 2021.
U.S. Appl. No. 29/819,438, filed Dec. 15, 2021.
U.S. Appl. No. 29/819,440, filed Dec. 15, 2021.
U.S. Appl. No. 17/573,911, filed Jan. 12, 2022.

CARRIER FOR CONTAINERS

CROSS-REFERENCE TO RELATED APPLICATIONS

This application claims the benefit of each of U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. Provisional Patent Application No. 63/136,400, filed on Jan. 12, 2021, and U.S. Provisional Patent Application No. 63/208,646, filed on Jun. 9, 2021.

INCORPORATION BY REFERENCE

The disclosures of each of U.S. Provisional Patent Application No. 62/779,689, filed on Dec. 14, 2018, U.S. Provisional Patent Application No. 62/783,752, filed on Dec. 21, 2018, U.S. Provisional Patent Application No. 62/796,830, filed on Jan. 25, 2019, U.S. Provisional Patent Application No. 62/797,585, filed on Jan. 28, 2019, U.S. Provisional Patent Application No. 62/810,015, filed on Feb. 25, 2019, U.S. Provisional Patent Application No. 62/814,412, filed on Mar. 6, 2019, U.S. Provisional Patent Application No. 62/817,120, filed on Mar. 12, 2019, U.S. Provisional Patent Application No. 62/84630227571,449, filed on May 1, 2019, U.S. patent application Ser. No. 16/426,050, filed on May 30, 2019, U.S. patent application Ser. No. 16/426,057, filed on May 30, 2019, U.S. patent application Ser. No. 16/426,060, filed on May 30, 2019, U.S. patent application Ser. No. 16/426,063, filed on May 30, 2019, U.S. patent application Ser. No. 16/426,066, filed on May 30, 2019, U.S. Design patent application No. 29/692,992, filed on May 30, 2019, U.S. Design patent application No. 29/692,993, filed on May 30, 2019, U.S. Design patent application No. 29/692,994, filed on May 30, 2019, U.S. Design patent application No. 29/692,996, filed on May 30, 2019, U.S. Design patent application No. 29/692,997, filed on May 30, 2019, U.S. patent application Ser. No. 16/598,282, filed on Oct. 10, 2019, U.S. Design patent application No. 29/709,918, filed on Oct. 18, 2019, U.S. Provisional Patent Application No. 62/952,839, filed on Dec. 23, 2019, U.S. Provisional Patent Application No. 62/956,882, filed on Jan. 3, 2020, U.S. Provisional Patent Application No. 62/985,997, filed on Mar. 6, 2020, U.S. patent application Ser. No. 16/829,346, filed on Mar. 25, 2020, and U.S. Provisional Patent Application No. 63/015,898, filed on Apr. 27, 2020, U.S. Provisional patent application No. 63/022,757, filed on May 11, 2020, U.S. Provisional Patent Application No. 63/023,442, filed on May 12, 2020, U.S. Design patent application No. 29/735,178, filed on May 19, 2020, U.S. Provisional Patent Application No. 63/031,615, filed on May 29, 2020, U.S. Design patent application No. 29/739,927, filed on Jun. 30, 2020, U.S. Design patent application No. 29/739,929, filed on Jun. 30, 2020, U.S. Design patent application No. 29/739,931, filed on Jun. 30, 2020, U.S. Design patent application No. 29/739,933, filed on Jun. 30, 2020, U.S. Design patent application No. 29/739,934, filed on Jun. 30, 2020, U.S. Provisional Patent Application No. 63/085,365, filed on Sep. 30, 2020, U.S. Provisional Patent Application No. 63/086,681, filed on Oct. 2, 2020, U.S. Provisional Patent Application No. 63/120,863, filed on Dec. 3, 2020, U.S. patent application Ser. No. 17/119,040, filed on Dec. 11, 2020, U.S. patent application Ser. No. 17/118,999, filed on Dec. 11, 2020, U.S. Provisional Patent Application No. 63/136,400, filed on Jan. 12, 2021, U.S. Design patent application No. 29/775,557, filed on Mar. 24, 2021, U.S. Design patent application No. 29/775,558, filed on Mar. 24, 2021, U.S. Design patent application No. 29/775,559, filed on Mar. 24, 2021, U.S. Design patent application No. 29/775,560, filed on Mar. 24, 2021, U.S. Provisional Patent Application No. 63/208,568, filed on Jun. 9, 2021, and U.S. Provisional Patent Application No. 63/208,646, filed on Jun. 9, 2021, U.S. Provisional Application No. 62/728,454, filed on Sep. 7, 2018, U.S. Provisional Patent Application No. 62/767,188, filed on Nov. 14, 2018, U.S. Provisional Patent Application No. 62/770,566, filed on Nov. 21, 2018, and U.S. Provisional Patent Application No. 63/214,868, filed on Jun. 25, 2021, U.S. Provisional Patent Application No. 63/216,062, filed on Jun. 29, 2021, and U.S. Provisional Patent Application No. 63/219,648, file d on Jul. 8, 2021, U.S. Provisional Patent Application No. 63/222,225, filed on Jul. 15, 2021, U.S. Provisional Patent Application No. 63/203,882, filed on Aug. 3, 2021, U.S. Provisional Patent Application No. 63/260,881, filed on Sep. 3, 2021, and U.S. Provisional Patent Application No. 63/261,582, filed on Sep. 24, 2021, are hereby incorporated by reference for all purposes as if presented herein in their entirety. The disclosures of each of U.S. Pat. No. 8,387,784, issued on Mar. 5, 2013, U.S. Pat. No. 8,096,413, issued on Jan. 17, 2012, and U.S. Pat. No. 11,027,905, issued on Jun. 8, 2021, are also hereby incorporated by reference for all purposes as if presented herein in their entirety.

BACKGROUND OF THE DISCLOSURE

The present disclosure generally relates to cartons or carriers for holding, displaying, and/or transporting containers.

SUMMARY OF THE DISCLOSURE

According to one aspect, the disclosure is generally directed to a carrier for holding a plurality of containers, the carrier comprising a top panel comprising a first plurality of container openings for at least partially receiving a respective container of the plurality of containers, at least one container retention flap foldably connected to the top panel and comprising a second plurality of container openings aligned with respective container openings of the first plurality of container openings for at least partially receiving a respective container of the plurality of containers, a plurality of container retention features for engaging respective containers of the plurality of containers, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, and at least one reinforcement panel positioned between the top panel and the at least one container retention flap.

According to another aspect, the disclosure is generally directed to a blank for forming a carrier for holding a plurality of containers, the blank comprising a top panel comprising a first plurality of container openings for at least partially receiving a respective container of the plurality of containers when the carrier is formed from the blank, at least one container retention flap foldably connected to the top panel and comprising a second plurality of container openings for being aligned with respective container openings of the first plurality of container openings for at least partially receiving a respective container of the plurality of containers when the carrier is formed from the blank, a plurality of container retention features for engaging respective containers of the plurality of containers when the carrier is formed from the blank, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, and at least one reinforcement panel positioned between the top panel and the at least one container retention flap.

According to another aspect, the disclosure is generally directed to a method of forming a carrier for holding a plurality of containers, the method comprising obtaining a blank comprising a top panel comprising a first plurality of container openings, at least one container retention flap foldably connected to the top panel and comprising a second plurality of container openings, a plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, the blank further comprising at least one reinforcement panel positioned between the top panel and the at least one container retention flap. The method further comprises folding the at least one container retention flap relative to the top panel such that respective container retention openings of the first plurality of container retention openings are aligned with respective container openings of the first plurality of container openings, and positioning the respective aligned container retention openings for at least partially receiving a respective container of the plurality of containers.

According to another aspect, the disclosure is generally directed to a package comprising a carrier holding a plurality of containers. The package comprises the plurality of containers and the carrier, the carrier comprising a top panel comprising a first plurality of container openings at least partially receiving a respective container of the plurality of containers, at least one container retention flap foldably connected to the top panel and comprising a second plurality of container openings aligned with respective container openings of the first plurality of container openings and at least partially receiving a respective container of the plurality of containers, a plurality of container retention features engaging respective containers of the plurality of containers, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, and at least one reinforcement panel positioned between the top panel and the at least one container retention flap.

Those skilled in the art will appreciate the above stated advantages and other advantages and benefits of various additional embodiments reading the following detailed description of the embodiments with reference to the below-listed drawing figures. It is within the scope of the present disclosure that the above-discussed aspects be provided both individually and in various combinations.

BRIEF DESCRIPTION OF THE DRAWINGS

According to common practice, the various features of the drawings discussed below are not necessarily drawn to scale. Dimensions of various features and elements in the drawings may be expanded or reduced to more clearly illustrate the embodiments of the disclosure.

Corresponding parts are designated by corresponding reference numbers throughout the drawings.

DETAILED DESCRIPTION

The present disclosure generally relates to carriers, packages, constructs, sleeves, cartons, or the like, for holding and displaying containers such as jars, bottles, cans, etc. The containers can be used for packaging food and beverage products, for example. The containers can be made from materials suitable in composition for packaging the particular food or beverage item, and the materials include, but are not limited to, glass; plastics such as PET, LDPE, LLDPE, HDPE, PP, PS, PVC, EVOH, and Nylon; and the like; aluminum and/or other metals; or any combination thereof.

Carriers according to the present disclosure can accommodate containers of numerous different shapes. For the purpose of illustration and not for the purpose of limiting the scope of the disclosure, the following detailed description describes beverage containers (e.g., aluminum cans) at least partially disposed within the carrier embodiments. In this specification, the terms "lower," "bottom," "upper," "top," "front," and "back" indicate orientations determined in relation to fully erected carriers.

As described herein, carriers may be formed by multiple overlapping panels, end flaps, and/or other portions of blanks. Such panels, end flaps, and/or other portions of the blank can be designated in relative terms to one another, e.g., "first", "second", "third", etc., in sequential or non-sequential reference, without departing from the disclosure.

Figure 1:
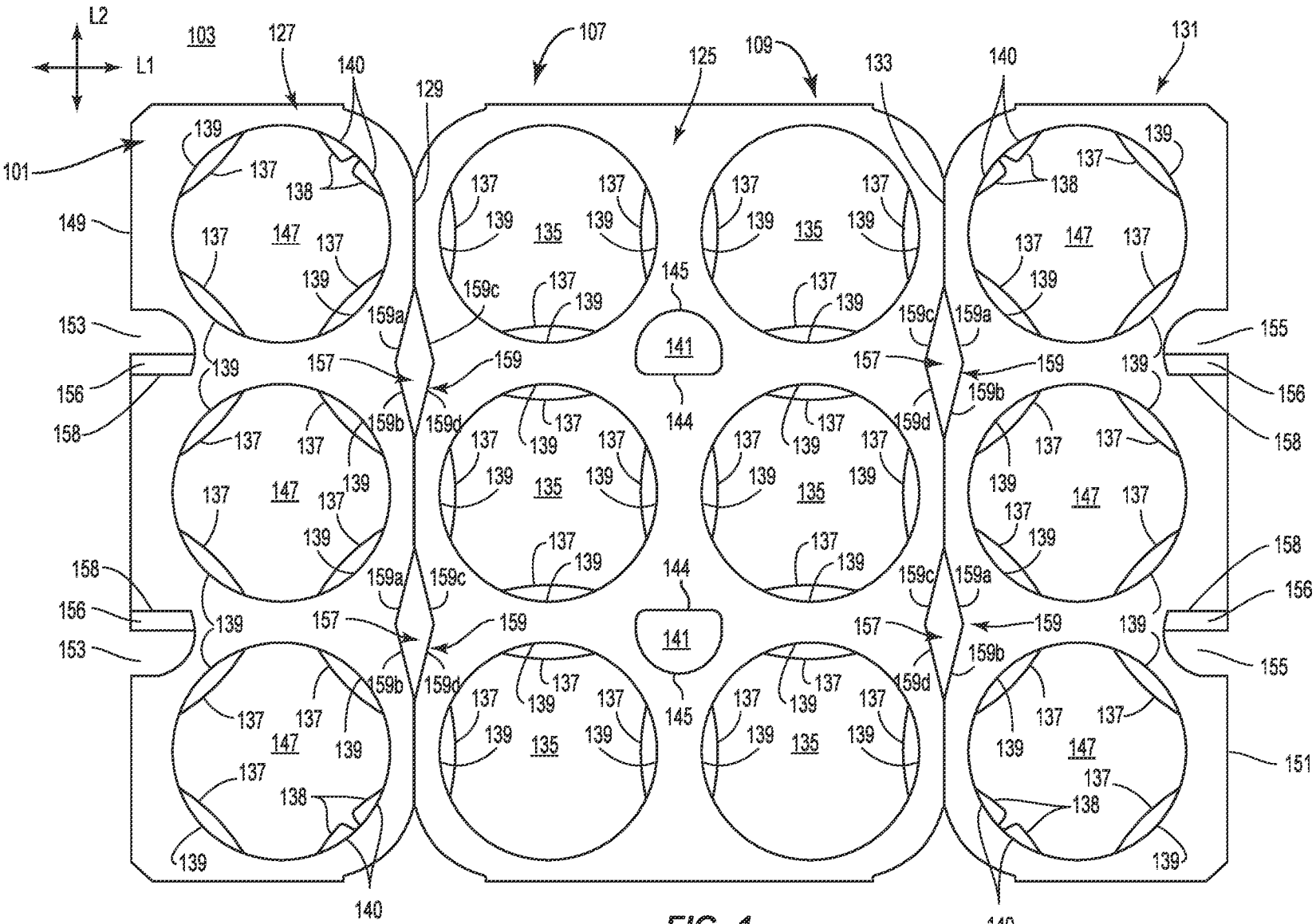
FIG. 1 is a plan view of an outer surface of a blank for forming a carrier according to a first exemplary embodiment of the disclosure.
Figure 2:
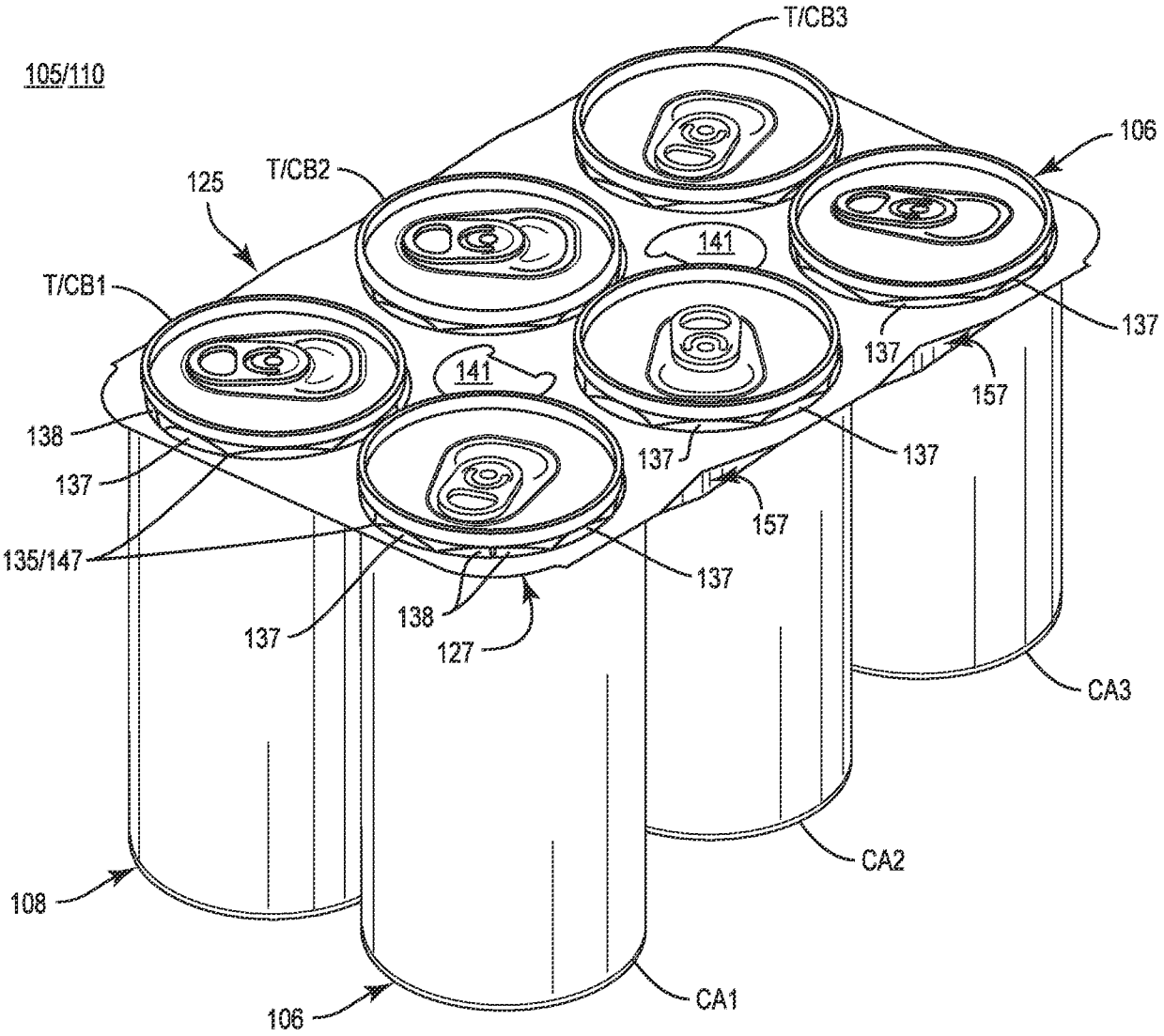
FIG. 2 is perspective view of a package including a carrier formed from the blank of FIG. 1 and a plurality of containers.

FIG. 1 shows a plan view of an exterior side 101 of a blank 103 used to form a carrier 105 (FIG. 2) in accordance with a first exemplary embodiment of the disclosure. As shown in FIG. 2, the carrier 105 is sized to contain or support six containers, with three containers CA1, CA2, CA3 being attached to a front portion 106 of the carrier 105 and three containers CB1, CB2, CB3 being attached to a back portion 108 of the carrier 105. In the illustrated embodiment, the containers CA1, CA2, CA3, CB1, CB2, CB3 can be beverage cans, or could be any other suitable type and size of container without departing from the disclosure. The carrier 105 can be provided together with one or more of the containers as a package 110.

The carrier 105 can be sized and shaped to hold more or less than six containers. In one embodiment, the front portion 106 and the back portion 108 of the carrier 105 each have three containers, and in other embodiments, the front portion 106 and the back portion 108 of the carrier 105 can carry more or less than three containers without departing from the disclosure.

As shown in FIG. 1, the blank 103 has a longitudinal axis L1 and a lateral axis L2. The blank 103 has a front portion 107 for forming the front portion 106 of the carrier 105 and a back portion 109 for forming the back portion 108 of the carrier 105.

In the illustrated embodiment, the blank 103 comprises a top panel 125 (broadly, "first top panel" or "central panel"), a container retention flap 127 (broadly, "first container retention flap", "first top flap", "second top panel", or "first container retention panel") foldably connected to the top panel 125 at a lateral fold line 129 (broadly, "first fold line"), and a container retention flap 131 (broadly, "second container retention flap", "second top flap", "third top panel", or "second container retention panel") foldably connected to the top panel 125 at a lateral fold line 133 (broadly, "second fold line").

The top panel 125 can have container retention features that include at least container openings 135 (broadly, "first plurality of container openings"). As shown, the container openings 135 can be provided in a column and row arrangement in a number that corresponds to a desired number of containers to be held by the carrier 105 formed from the blank 103. While the top panel 125 is shown having container openings 135 provided in two rows/columns of three openings 135 each, it will be understood that a different number and/or arrangement of container retention openings 135 can be provided without departing from the disclosure.

As shown in FIG. 1, the container openings 135 can have a generally circular configuration, with container retention tabs 137 (broadly, "first container retention tabs" or "first container retention protrusions") at least partially foldably connected to the top panel 125 at respective curved fold lines 139 and positioned extending into/toward the container opening 135 on laterally and longitudinally opposite sides thereof. In the illustrated embodiment, the blank 103 can be devoid of container retention tabs 137 on sides of the container openings 135 adjacent free edges of the top panel 124. It will be understood that one or more of the container retention tabs 137 can have a different configuration or arrangement without departing from the disclosure. For example, in one embodiment, the container retention tabs 137 can have the form of edges of the top panel 125 that protrude into the respective container openings 135.

The blank 103/carrier 105 can also have handle features that include at least one handle tab 141 foldably connected to the top panel 125 at a longitudinal fold line 144 and at least partially defined by a curved cut 145 extending from one endpoint of the fold line 144 to the other endpoint of the fold line 144. As described further herein, the handle tabs 141 can be separated from the top panel 125 to form respective handle openings for user engagement of the carrier 105. In one embodiment, the top panel 125 can be devoid of the handle tabs 141, and can instead be provided with corresponding handle openings.

Still referring to FIG. 1, each of the container retention flaps 127, 131 includes respective container openings 147 (broadly, "second plurality of container openings"). The container openings 147 are for being aligned with the respective container openings 135 when the carrier 105 is formed from the blank 103, as described further herein.

As shown, the container openings 147 can have a generally circular configuration, with container retention tabs 137 (broadly, "second container retention tabs" or "second container retention protrusions") at least partially foldably connected to the top panel 125 at respective curved fold lines 139 and positioned extending into/toward the container retention opening 147 on obliquely opposite sides thereof. In this regard, the container retention tabs 137 are arranged along the edges of the respective container retention openings 137 at positions generally 45° offset to those positions of the container retention tabs 137 arranged along the edges of the container retention openings 135 in the top panel 125 (e.g., as measured relative to an axis parallel to one of the axes L1, L2 and extending through the respective container openings 135). As described further herein, the container openings 135/container retention tabs 137 associated with the top panel 125 are circumferentially offset from and cooperate with the container openings 147/container retention tabs 137 associated with the container retention flaps 127, 131 to provide an enhanced engagement with containers held by the carrier 105.

In the illustrated embodiment, a pair of container retention tabs 138 (broadly, "second plurality of container retention tabs" or "third plurality of container retention tabs") can be foldably connected to the respective container retention flaps 127, 131 at respective curved fold lines 140 along edges of the respective container openings facing a free edge thereof and adjacent the respective fold line 129, 133. It will be understood that one or more of the container retention tabs 138 can have a different configuration or arrangement without departing from the disclosure.

As also shown, the container retention flaps 127, 131 have respective lateral free edges 149, 151 that define respective recessed portions 153, 155. As described further herein, when the carrier 105 is formed from the blank 103, the recessed portions 153, 155 are positionable abutting and/or at least partially surrounding a respective handle tab 141 to provide clearance and/or reinforcement for user engagement of the carrier 105. In this regard, the recessed portions 153, 155 can also form handle features of the blank 103/carrier 105. In one embodiment, and as shown, handle reinforcement tabs 156 can be foldably connected to each container retention flap 127, 131 at respective longitudinal fold lines 158, and can be positioned to extend at least partially into the respective recessed portions 153, 155.

With continued reference to FIG. 1, the blank 103/carrier 105 formed therefrom can be configured to stiffen/inhibit relative movement of portions of the blank 103/carrier 105 when in use. As shown, a pair of laterally-spaced reinforcement panels 157 (broadly, "first reinforcement feature") can be positioned interrupting the fold line 129. Each reinforcement panel 157, as shown, can be a region of the blank 103/carrier 105 between the top panel 125 and the container retention flap 127 and that is defined by a line of weakening 159 extending between endpoints of segments of the fold line 129.

The line of weakening 159, as shown, can include a plurality of intersecting oblique segments 159*a*, 159*b*, 159*c*, 159*d*. In the illustrated embodiment, each of the segments 159*a*, 159*b*, 159*c*, 159*d* can be arranged so as to form a generally rhomboid/diamond-shaped reinforcement panel 157. In one embodiment, each of the segments 159*a*, 159*b*, 159*c*, 159*d* of the line of weakening 159 can be arranged at an angle of about 45° relative to each of the axes L1, L2. It will be understood that one or more of the lines of weakening 159/reinforcement panels 157 can have one or more different features, e.g., curved and/or longitudinal/lateral portions, without departing from the disclosure.

As shown, a pair of longitudinally-spaced reinforcement panels 157 can also be provided interrupting the fold line 133 so as to be positioned between the top panel 125 and the container retention flap 131. It will be understood that a different number and/or arrangement of the reinforcement panels 157 can be provided without departing from the disclosure.

Any of the panels, flaps, fold lines, cuts, or other features could be otherwise shaped, arranged, and/or omitted from the blank 103 without departing from the disclosure. The blank 103 could be sized and/or shaped to accommodate more or less than eight containers without departing from this disclosure.

With additional reference to FIG. 2, according to one exemplary embodiment of forming the carrier 105/package 110, the blank 103 can be positioned above a group of containers and the container retention flaps 127, 131 can be folded toward the interior surfaced/underside of the blank 103 at the respective fold lines 129, 133 such that the container openings 147 of the respective container retention flaps 127, 131 align with the respective container openings 135 of the top panel 125.

Figure 3:
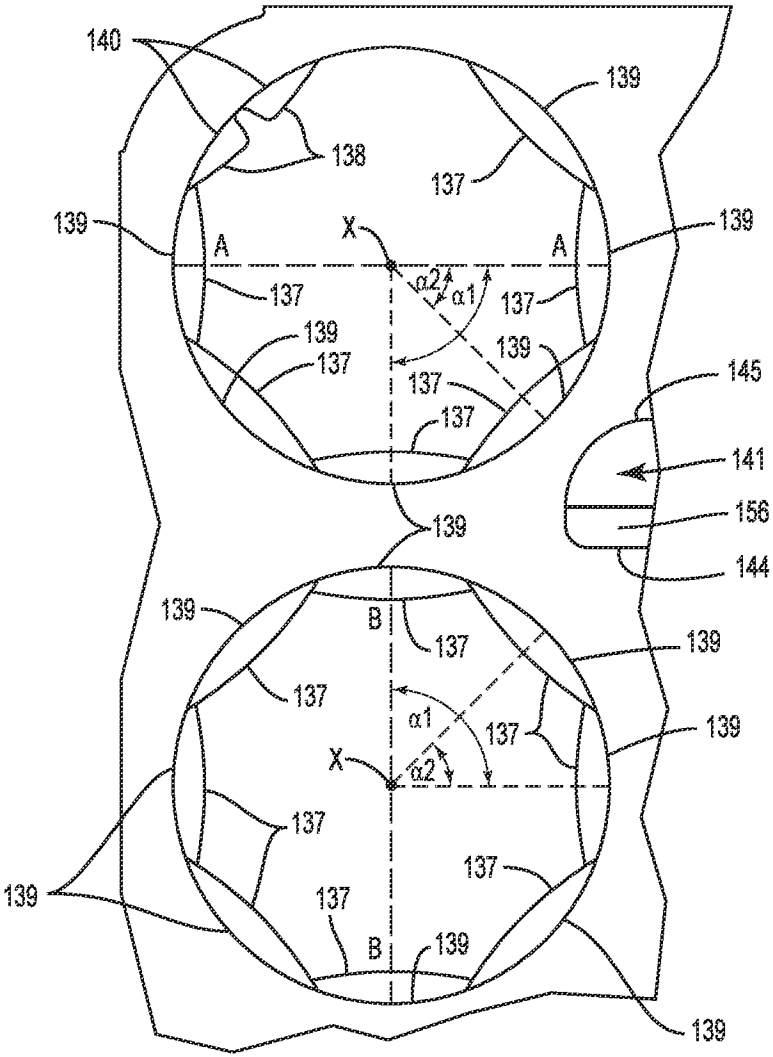
FIG. 3 is a schematic plan view of overlapping container retention features of the carrier of FIG. 2.
Figure 4:
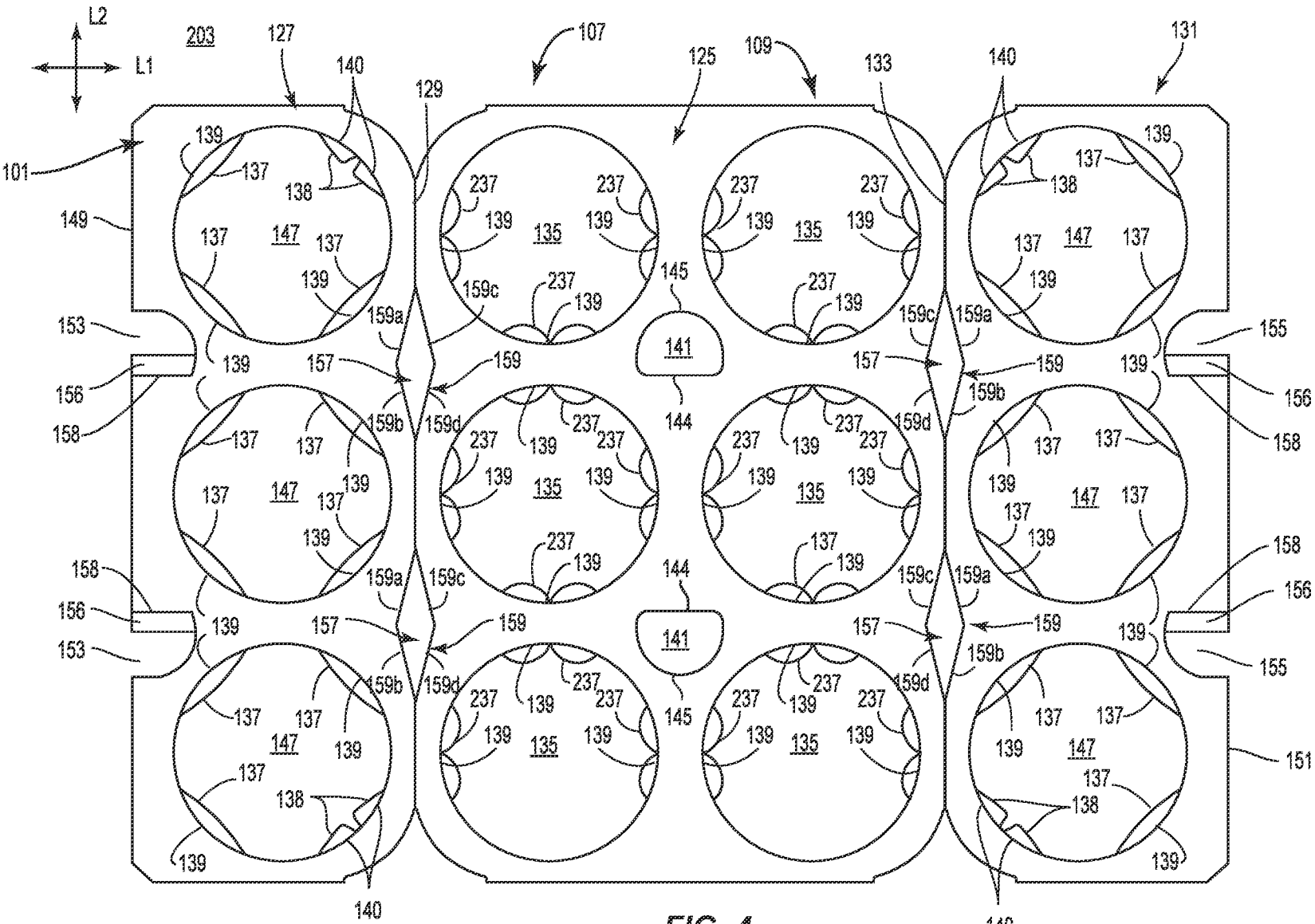
FIG. 4 is a plan view of a blank for forming a carrier according to a second exemplary embodiment of the disclosure.

In such an arrangement the top panel 125 can be in at least partial face-to-face contact with respective portions of the container retention flaps 127, 131 such that the container openings 135, 137 are aligned so as to have a common center X (FIG. 3)

In such an arrangement, the blank 103 can be lowered upon the containers CA1, CA2, CA3, CB1, CB2, CB3 such that upper or top portions T of the respective containers CA1, CA2, CA3 can be at least partially received through the respective aligned container openings 135, 147.

Accordingly, the edge of the container retention flaps 127, 131 surrounding the respective container openings 147 at least partially receive a top portion T of the respective containers, e.g., a rolled rim of the respective containers, and the container openings 135 subsequently receive the respective top portions T of the respective containers.

Such movement of the respective top portions T of the respective containers through the respective container openings 135 can cause the container retention tabs 137, 138 to be urged upwardly at the respective fold lines 139 so as to extend at least partially upwardly relative to the top panel 125. In this regard, the container retention tabs 137, 139 can extend from the top panel 125 to contact the rolled rim or other structure of the top portion T of the respective containers to take up/fill any spacing therebetween and contribute to a stiff and stable engagement of the top panel 125 with the respective containers.

With additional reference to FIG. 3, the arrangement of the container retention tabs 137 foldably connected to the top panel 125 overlying the container retention tabs 137, 138 foldably connected to the respective container retention flaps 127, 131 is such to provide a generally overlapping arrangement thereof, with the respective container retention tabs 137 of the top panel 125 interspersed between respective container retention tabs 137, 138 of the container retention flaps 127, 131 therebelow.

As shown, the center of a container retention tab 137 can have a circumferential position along the container opening 135 an angle α1 of about 90° measured from an axis A extending through the common center X of the aligned container openings 135, 137, (broadly, "first circumferential position") and container retention tab 138 can have a center with a circumferential position along the container opening 147 an angle α2 of about 45° measured from an axis A (broadly, "second circumferential position"), with next successive container retention tabs 137, 138 having circumferential positions repeating at 90° intervals measured from the axis A. Similarly, the center of a container retention tab 137 can have a circumferential position along the container opening 135 an angle α1 of about 90° measured from an axis B extending through the common center X of the aligned container openings 135, 137, (broadly, "first circumferential position") and container retention tab 138 can have a center with a circumferential position along the container opening 147 an angle α2 of about 45° measured from an axis B (broadly, "second circumferential position"), with next successive container retention tabs 137, 138 having circumferential positions repeating at 90° intervals measured from the axis B. As shown, the axis A can be an axis generally parallel to the lateral axis L1 and the axis B can be generally parallel to the axis L2, though the axes can be any axes through the common center X of the aligned container openings 135, 137 such that the container retention tabs 137, 138 have circumferential positions at offset angles therefrom about the respective container openings 135, 137. For example, in one embodiment, container retention tabs 137 can be positioned at angles of about 0°, about 90°, about 180°, and about 270° relative to the axis B, and container retention tabs 137 can be positioned at angles of about 45°, about 135°, about 225°, and about 315° relative to the axis B. It will be understood that the container retention tabs 137, 138 can be positioned at different offset circumferential positions than shown, e.g., such that α1 and α2 have different values (and that differ from each other).

Furthermore, the container retention tabs 137, 138 are provided with a size sufficient to allow for circumferential overlap of the respective container retention tabs 137 of the top panel 125 interspersed between respective container retention tabs 137, 138 of the container retention flaps 127, 131 therebelow. In this regard, when the container retention tabs 137, 138 of the respective container retention flaps 127, 131 and the container retention tabs 137 of the top panel 125 are folded upwardly at the respective fold lines 139 to extend through the aligned container openings 147, 135, at least a portion of more than one respective container retention tab occupies the same circumferential location along the respective aligned container openings 147, 135, e.g., such that at least one of the container retention tabs 137 is in at least partial face-to-face contact with at least one of the container retention tabs 138. In this regard, the arrangement of container retention tabs 137, 138 against the respective containers minimizes empty space therebetween to ensure a tight and secure fit between the carrier 105 and the containers CA1, CA2, CA3, CB1, CB2, CB3. In one embodiment, such overlapping arrangement of container retention tabs 137, 138 can serve to pin or brace the respective containers in a desired location.

In addition, the overlapping relationship of respective portions of the top panel 125 with the container retention flaps 127, 131 is such that the container retention flaps 127, 131 provide an underlying support or shelf-like feature that can minimize/resist bending, buckling, flexion, torsion, etc. and provide a stable platform from which the top panel 125 and container retention tabs 137, 139 extending upwardly therefrom are supported.

Further to the support provided by the 2-ply/overlapping engagement of the top panel 125 with the container retention flaps 127, 131, the reinforcement panels 157 are presented in an outward-facing arrangement relative to the top panel 125 and the container retention flaps 127, 131 so as to form a generally upright/vertical structure that further minimizes/resists bending, buckling, flexion, torsion, etc. of the carrier 105/package 110 relative to a plane defined by the top panel 125 and/or the container retention flaps 127, 131, e.g., such that the carrier 105/package 110 minimizes/resists such forces/movement along both the longitudinal axis L1 and the lateral axis L2.

The package 110/carrier 105 can be grasped by a consumer by separating one or both handle tabs 141 from the top panel at the respective cuts 145 and folding the handle tab 141 downwardly at the respective fold line 144 to form a respective handle opening in the top panel 125 through which the user can insert one or more of his or her fingers. As described above, the recessed portions 153, 155 of the respective container retention flaps 127, 131 can be positioned abutting/surrounding the respective handle openings such that a user can engage the underside of the respective container retention flaps 127, 131 and/or a portion of the top panel 125, e.g., adjacent the respective recessed portion 153, 155, in order to engage and lift/carry or otherwise move the carrier 105/package 110. Such engagement of the underside of the carrier 105 can include at least partial folding of the handle reinforcement tabs 156 at the respective fold line 158.

Furthermore, upon formation of the package 110/carrier 105 respective containers CAL CA2, CA3, CB1, CB2, CB3 can be removed from the carrier 105 by disengaging the container the top panel 125 and respective container retention flap 127, 131, for example, by withdrawing the top portion T of a respective container through respective aligned container openings 135, 147.

It will be understood that the carrier 105/package 110 can have a different configuration without departing from the disclosure.

Figure 5:
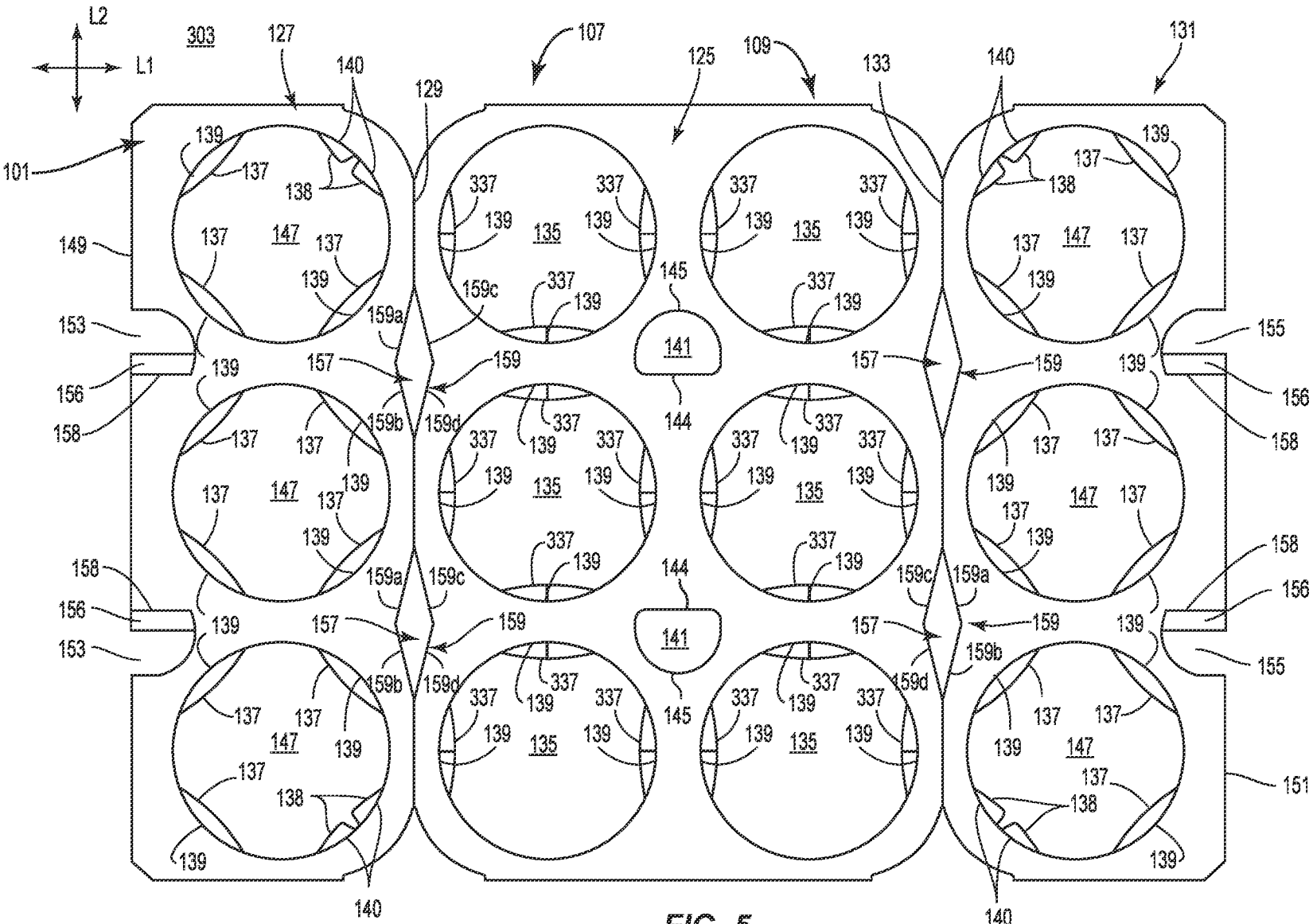
FIG. 5 is a plan view of a blank for forming a carrier according to a third exemplary embodiment of the disclosure.

FIGS. 5 and 6 are plan views of the exterior sides of blank, generally indicated at 203, 303, respectively, used to form carriers for supporting/holding one or more containers according to second and third exemplary embodiments of the disclosure, respectively. As shown, the blanks 203, 303 can be generally similar to the blank 103 of the first exemplary embodiment, and like or similar features are provided with like or similar reference numerals.

As shown, the blank 203 can include a different configuration of the container retention tabs 137 positioned extending into the container openings 135, designated 237. As shown, the container retention tabs 237 can have a generally bifurcated configuration so at to be at least partially separated into two portions at a line of weakening. It will be understood that a different number, configuration, and/or arrangement of container retention tabs can be provided without departing from the disclosure. The blank 203 can be formed into a package and carrier in a manner similar to that described above with regard to the carrier 105/package 110, so as to provide similar advantages.

As also shown, the blank 303 can include a different configuration of the container retention tabs 137 positioned extending into the container openings 135, designated 337. As shown, the container retention tabs 337 can have a generally bifurcated configuration so at to be at least partially separated into two portions at a line of weakening in a manner different than illustrated above with regard to the container retention tabs 237. It will be understood that a different number, configuration, and/or arrangement of container retention tabs can be provided without departing from the disclosure. The blank 303 can be formed into a package and carrier in a manner similar to that described above with regard to the carrier 105/package 110, so as to provide similar advantages.

In general, the blank may be constructed from paperboard having a caliper so that it is heavier and more rigid than ordinary paper. The blank can also be constructed of other materials, such as cardboard, or any other material having properties suitable for enabling the carrier to function at least generally as described above. The blank can be coated with, for example, a clay coating. The clay coating may then be printed over with product, advertising, and other information or images. The blanks may then be coated with a varnish to protect information printed on the blanks. The blanks may also be coated with, for example, a moisture barrier layer, on either or both sides of the blanks. The blanks can also be laminated to or coated with one or more sheet-like materials at selected panels or panel sections.

As an example, a tear line can include: a slit that extends partially into the material along the desired line of weakness, and/or a series of spaced apart slits that extend partially into and/or completely through the material along the desired line of weakness, or various combinations of these features. As a more specific example, one type tear line is in the form of a series of spaced apart slits that extend completely through the material, with adjacent slits being spaced apart slightly so that a nick (e.g., a small somewhat bridging-like piece of the material) is defined between the adjacent slits for typically temporarily connecting the material across the tear line. The nicks are broken during tearing along the tear line. The nicks typically are a relatively small percentage of the tear line, and alternatively the nicks can be omitted from or torn in a tear line such that the tear line is a continuous cut line. That is, it is within the scope of the present disclosure for each of the tear lines to be replaced with a continuous slit, or the like. For example, a cut line can be a continuous slit or could be wider than a slit without departing from the present disclosure.

In accordance with the exemplary embodiments, a fold line can be any substantially linear, although not necessarily straight, form of weakening that facilitates folding therealong. More specifically, but not for the purpose of narrowing the scope of the present disclosure, fold lines include: a score line, such as lines formed with a blunt scoring knife, or the like, which creates a crushed or depressed portion in the material along the desired line of weakness; a cut that extends partially into a material along the desired line of weakness, and/or a series of cuts that extend partially into and/or completely through the material along the desired line of weakness; and various combinations of these features. In situations where cutting is used to create a fold line, typically the cutting will not be overly extensive in a manner that might cause a reasonable user to incorrectly consider the fold line to be a tear line.

The above embodiments may be described as having one or more panels adhered together by glue during erection of the carrier embodiments. The term "glue" is intended to encompass all manner of adhesives commonly used to secure carrier panels in place.

The foregoing description of the disclosure illustrates and describes various exemplary embodiments. Various additions, modifications, changes, etc., could be made to the exemplary embodiments without departing from the spirit and scope of the disclosure. It is intended that all matter contained in the above description or shown in the accompanying drawings shall be interpreted as illustrative and not in a limiting sense. Additionally, the disclosure shows and describes only selected embodiments of the disclosure, but the disclosure is capable of use in various other combinations, modifications, and environments and is capable of changes or modifications within the scope of the inventive concept as expressed herein, commensurate with the above teachings, and/or within the skill or knowledge of the relevant art. Furthermore, certain features and characteristics of each embodiment may be selectively interchanged and applied to other illustrated and non-illustrated embodiments of the disclosure.

What is claimed is:

1. A carrier for holding a plurality of containers, the carrier comprising:

a top panel comprising a first plurality of container openings for at least partially receiving a respective container of the plurality of containers;

at least one container retention flap foldably connected to the top panel and comprising a second plurality of container openings aligned with respective container openings of the first plurality of container openings for at least partially receiving a respective container of the plurality of containers;

a plurality of container retention features for engaging respective containers of the plurality of containers, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab; and at least one reinforcement panel positioned between the top panel and the at least one container retention flap.

2. The carrier of claim 1, wherein the top panel is in at least partial face-to-face contact with the at least one container retention flap.

3. The carrier of claim 2, wherein the at least one first container retention tab is positioned about 90° from the axis extending through the common center, and the at least one second container retention tab is positioned about 45° from the axis extending through the common center.

4. The carrier of claim 2, wherein the at least one first container retention tab is in at least partial face-to-face contact with the at least one second container retention tab.

5. The carrier of claim 4, wherein the at least one reinforcement panel is generally upright relative to the top panel.

6. The carrier of claim 5, wherein the at least one reinforcement panel is formed by a line of weakening.

7. The carrier of claim 6, wherein the line of weakening includes a plurality of oblique line segments, each oblique line segment of the plurality of oblique line segments intersecting at least one other line segment of the plurality of oblique line segments.

8. The carrier of claim 7, wherein the at least one reinforcement panel has a generally diamond-shaped configuration.

9. The carrier of claim 7, wherein the at least one container retention flap is foldably connected to the top panel at a first fold line, the at least one reinforcement panel interrupts the first fold line.

10. The carrier of claim 9, wherein the at least one reinforcement panel is a first reinforcement panel, the at least one container retention flap is a first container retention flap, the carrier further comprises a second container retention flap foldably connected to the top panel at a second fold line, and the carrier further comprises a second reinforcement panel interrupting the second fold line.

11. The carrier of claim 4, wherein the at least one container retention flap is a first container retention flap foldably connected to the top panel, and the carrier further comprises a second container retention flap foldably connected to the top panel, wherein the second container retention flap comprises at least one container opening of the second plurality of container openings.

12. The carrier of claim 11, wherein the first container retention flap is foldably connected to the top panel at a first fold line, the at least one reinforcement panel interrupts the first fold line.

13. The carrier of claim 11, wherein the at least one reinforcement panel is a first reinforcement panel, the second container retention flap is foldably connected to the top panel at a second fold line, and the carrier further comprises a second reinforcement panel interrupting the second fold line.

14. The carrier of claim 1, wherein the top panel is in at least partial face-to-face contact with the at least one container retention flap such that the respective container openings of the first plurality of container openings are aligned to have a common center with the respective container openings of the second plurality of container openings, the at least one first container retention tab has a first circumferential position measured from an axis extending through the common center, the at least one second container retention tab has a second circumferential position measured from the axis extending through the common center, the first circumferential position is different than the second circumferential position.

15. A blank for forming a carrier for holding a plurality of containers, the blank comprising:

a top panel comprising a first plurality of container openings for at least partially receiving a respective container of the plurality of containers when the carrier is formed from the blank;

at least one container retention flap foldably connected to the top panel and comprising a second plurality of container openings for being aligned with respective container openings of the first plurality of container openings for at least partially receiving a respective container of the plurality of containers when the carrier is formed from the blank;

a plurality of container retention features for engaging respective containers of the plurality of containers when the carrier is formed from the blank, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab; and at least one reinforcement panel positioned between the top panel and the at least one container retention flap.

16. The blank of claim 15, wherein the at least one first container retention tab is for being positioned in at least partial face-to-face contact with the at least one second container retention tab when the carrier is formed from the blank.

17. The blank of claim 16, wherein the at least one reinforcement panel is formed by a line of weakening.

18. The blank of claim 17, wherein the line of weakening includes a plurality of oblique line segments, each oblique line segment of the plurality of oblique line segments intersecting at least one other line segment of the plurality of oblique line segments.

19. The blank of claim 18, wherein the at least one reinforcement panel has a generally diamond-shaped configuration.

20. The blank of claim 18, wherein the at least one container retention flap is foldably connected to the top panel at a first fold line, the at least one reinforcement panel interrupts the first fold line.

21. The blank of claim 20, wherein the at least one reinforcement panel is a first reinforcement panel, the at least one container retention flap is a first container retention flap, the carrier further comprises a second container retention flap foldably connected to the top panel at a second fold line, and the carrier further comprises a second reinforcement panel interrupting the second fold line.

22. The blank of claim 16, wherein the at least one container retention flap is a first container retention flap foldably connected to the top panel, and the carrier further comprises a second container retention flap foldably connected to the top panel, wherein the second container retention flap comprises at least one container opening of the second plurality of container openings.

23. The blank of claim 22, wherein the first container retention flap is foldably connected to the top panel at a first fold line, the at least one reinforcement panel interrupts the first fold line.

24. The blank of claim 22, wherein the at least one reinforcement panel is a first reinforcement panel, the second container retention flap is foldably connected to the top panel at a second fold line, and the carrier further comprises a second reinforcement panel interrupting the second fold line.

25. The blank of claim 15, wherein the top panel is for being positioned in at least partial face-to-face contact with the at least one container retention flap such that the respective container openings of the first plurality of container openings are aligned to have a common center with the respective container openings of the second plurality of container openings when the carrier is formed from the blank, the at least one first container retention tab has a first circumferential position measured from an axis extending through the common center when the carrier is formed from the blank, the at least one second container retention tab has a second circumferential position measured from the axis extending through the common center when the carrier is formed from the blank, the first circumferential position is different than the second circumferential position.

26. The blank of claim 15, wherein the at least one first container retention tab is positioned about 90° from the axis extending through the common center when the carrier is formed from the blank, and the at least one second container retention tab is for being positioned about 45° from the axis extending through the common center when the carrier is formed from the blank.

27. A method of forming a carrier for holding a plurality of containers, the method comprising:

obtaining a blank comprising a top panel comprising a first plurality of container openings, at least one container retention flap foldably connected to the top panel and comprising a second plurality of container openings, a plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab, the blank further comprising at least one reinforcement panel positioned between the top panel and the at least one container retention flap;

folding the at least one container retention flap relative to the top panel such that respective container retention openings of the first plurality of container retention openings are aligned with respective container openings of the first plurality of container openings; and positioning the respective aligned container retention openings for at least partially receiving a respective container of the plurality of containers.

28. The method of claim 27, wherein the folding the at least one container retention flap comprises positioning the at least one container retention flap in at least partial face-to-face contact with the top panel.

29. The method of claim 28, wherein the at least one first container retention tab is positioned about 90° from the axis extending through the common center, and the at least one second container retention tab is positioned about 45° from the axis extending through the common center.

30. The method of claim 28, wherein the folding the at least one container retention flap comprises positioning the at least one first container retention tab in at least partial face-to-face contact with the at least one second container retention tab.

31. The method of claim 30, wherein the at least one reinforcement panel is generally upright relative to the top panel.

32. The method of claim 31, wherein the at least one reinforcement panel is formed by a line of weakening.

33. The method of claim 32, wherein the line of weakening includes a plurality of oblique line segments, each oblique line segment of the plurality of oblique line segments intersecting at least one other line segment of the plurality of oblique line segments.

34. The method of claim 33, wherein the at least one reinforcement panel has a generally diamond-shaped configuration.

35. The method of claim 33, wherein the at least one container retention flap is foldably connected to the top panel at a first fold line, the at least one reinforcement panel interrupts the first fold line.

36. The method of claim 35, wherein the at least one reinforcement panel is a first reinforcement panel, the at least one container retention flap is a first container retention flap, and the carrier further comprises a second container retention flap foldably connected to the top panel at a second fold line, and the carrier further comprises a second reinforcement panel interrupting the second fold line.

37. The method of claim 30, wherein the at least one container retention flap is a first container retention flap foldably connected to the top panel, and the carrier further comprises a second container retention flap foldably connected to the top panel, wherein the second container retention flap comprises at least one container opening of the second plurality of container openings.

38. The method of claim 37, wherein the first container retention flap is foldably connected to the top panel at a first fold line, the at least one reinforcement panel interrupts the first fold line.

39. The method of claim 37, wherein the at least one reinforcement panel is a first reinforcement panel, the second container retention flap is foldably connected to the top panel at a second fold line, and the carrier further comprises a second reinforcement panel interrupting the second fold line.

40. The method of claim 27, wherein the folding the at least one container retention flap comprises positioning the at least one container retention flap in at least partial face-to-face contact with the top panel such that the respective container openings of the first plurality of container openings are aligned to have a common center with the respective container openings of the second plurality of container openings, and such that the at least one first container retention tab has a first circumferential position measured from an axis extending through the common center, and such that the at least one second container retention tab has a second circumferential position measured from the axis extending through the common center, the first circumferential position is different than the second circumferential position.

41. A package comprising a carrier holding a plurality of containers, the package comprising:

the plurality of containers; and the carrier, the carrier comprising:

a top panel comprising a first plurality of container openings at least partially receiving a respective container of the plurality of containers;

at least one container retention flap foldably connected to the top panel and comprising a second plurality of container openings aligned with respective container openings of the first plurality of container openings and at least partially receiving a respective container of the plurality of containers;

a plurality of container retention features engaging respective containers of the plurality of containers, the plurality of container retention features comprising at least one first container retention tab foldably connected to the top panel and extending toward a respective container opening of the first plurality of container openings, and at least one second container retention tab foldably connected to the at least one container retention flap and extending toward a respective container opening of the second plurality of container openings, the at least one second container retention tab is circumferentially offset relative to the at least one first container retention tab; and at least one reinforcement panel positioned between the top panel and the at least one container retention flap.

42. The package of claim 41, wherein the top panel is in at least partial face-to-face contact with the at least one container retention flap.

43. The package of claim 42, wherein the at least one first container retention tab is positioned about 90° from the axis extending through the common center, and the at least one second container retention tab is positioned about 45° from the axis extending through the common center.

44. The package of claim 42, wherein the at least one first container retention tab is in at least partial face-to-face contact with the at least one second container retention tab.

45. The package of claim 44, wherein the at least one reinforcement panel is generally upright relative to the top panel.

46. The package of claim 45, wherein the at least one reinforcement panel is formed by a line of weakening.

47. The package of claim 46, wherein the line of weakening includes a plurality of oblique line segments, each oblique line segment of the plurality of oblique line segments intersecting at least one other line segment of the plurality of oblique line segments.

48. The package of claim 47, wherein the at least one reinforcement panel has a generally diamond-shaped configuration.

49. The package of claim 47, wherein the at least one container retention flap is foldably connected to the top panel at a first fold line, the at least one reinforcement panel interrupts the first fold line.

50. The package of claim 49, wherein the at least one reinforcement panel is a first reinforcement panel, the at least one container retention flap is a first container retention flap, the carrier further comprises a second container retention flap is foldably connected to the top panel at a second fold line, and the carrier further comprises a second reinforcement panel interrupting the second fold line.

51. The package of claim 44, wherein the at least one container retention flap is a first container retention flap foldably connected to the top panel, and the carrier further comprises a second container retention flap foldably connected to the top panel, wherein the second container retention flap comprises at least one container opening of the second plurality of container openings.

52. The package of claim 51, wherein the first container retention flap is foldably connected to the top panel at a first fold line, the at least one reinforcement panel interrupts the first fold line.

53. The package of claim 51, wherein the at least one reinforcement panel is a first reinforcement panel, the second container retention flap is foldably connected to the top panel at a second fold line, and the carrier further comprises a second reinforcement panel interrupting the second fold line.

54. The package of claim 41, wherein the top panel is in at least partial face-to-face contact with the at least one container retention flap such that the respective container openings of the first plurality of container openings are aligned to have a common center with the respective container openings of the second plurality of container openings, the at least one first container retention tab has a first circumferential position measured from an axis extending through the common center, the at least one second container retention tab has a second circumferential position measured from the axis extending through the common center, the first circumferential position is different than the second circumferential position.

* * * * *